US006106365A

United States Patent [19]

Gessler

[11] Patent Number: 6,106,365

[45] Date of Patent: Aug. 22, 2000

[54] METHOD AND APPARATUS TO CONTROL MOUNTING PRESSURE OF SEMICONDUCTOR CRYSTALS

[75] Inventor: Ryan W. Gessler, Vancouver, Wash.

[73] Assignee: SEH America, Inc., Vancouver, Wash.

[21] Appl. No.: 09/187,043

[22] Filed: Nov. 6, 1998

[51] Int. Cl.[7] ..... B24B 49/00

[52] U.S. Cl. ..... 451/8; 451/9; 451/59; 125/28

[58] Field of Search ..... 125/28, 16.02, 125/13.01; 451/460, 8, 9, 59, 397, 398, 408; 198/401

[56] References Cited

U.S. PATENT DOCUMENTS

| | | | |
|---|---|---|---|
| 4,565,094 | 1/1986 | Sedgewick | 451/15 |
| 4,667,650 | 5/1987 | Girard et al. . | |
| 4,773,951 | 9/1988 | Moffatt et al. . | |
| 4,852,434 | 8/1989 | Bald | 451/26 |
| 4,897,141 | 1/1990 | Girard . | |
| 4,949,700 | 8/1990 | Ebashi . | |
| 5,720,271 | 2/1998 | Hauser . | |
| 5,735,258 | 4/1998 | Okuno et al. | 125/16.02 |
| 5,839,424 | 11/1998 | Hauser | 125/16.02 |
| 5,857,454 | 1/1999 | Shibaoka | 125/16.02 |
| 5,878,737 | 3/1999 | Hodsden | 125/16.02 |
| 5,896,851 | 4/1999 | Katamachi et al. | 125/16.02 |

*Primary Examiner*—M. Rachuba
*Attorney, Agent, or Firm*—Oliff & Berridge, PLC

[57] ABSTRACT

A method and apparatus for controlling a mounting pressure for semiconductor ingots provide appropriate mounting pressure so that a high quality bond is formed between a semiconductor ingot and a mounting beam. The pressure between the semiconductor ingot and the mounting beam can be directly determined, but other indications representative of the pressure can be also used to control the mounting pressure.

19 Claims, 2 Drawing Sheets

METHOD AND APPARATUS TO CONTROL MOUNTING PRESSURE OF SEMICONDUCTOR CRYSTALS

BACKGROUND OF THE INVENTION

1. Field of Invention

This invention relates to mounting semiconductor ingots to a mounting beam. In particular, the invention relates to controlling the force used to hold a semiconductor ingot and mounting beam together when bonding the two together.

2. Description of Related Art

Semiconductor wafers are typically formed by first growing a relatively large semiconductor ingot, or crystal, from molten semiconductor material. The semiconductor ingot typically has a cylindrical shape, and disc-shaped wafers are individually cut from the ingot.

The semiconductor wafer manufacturing process is carefully controlled to produce wafers having uniform and predictable parameters, including bow, warp, thickness, taper, crystallographic orientation and/or surface appearance. To produce semiconductor wafers having desired properties, it is important that the semiconductor ingot be held very firmly during wafer cutting. One method for firmly holding a semiconductor ingot during cutting involves mounting the ingot to a cutting or mounting beam by an epoxy resin. Thus, the semiconductor ingot can be held firmly in place during wafer cutting by firmly mounting the mounting beam in the cutting apparatus.

Since the stability of the semiconductor ingot in the cutting apparatus depends upon the quality of the bond between the mounting beam and the semiconductor ingot, it is important to assure that the ingot is properly bonded to the mounting beam. Thus, an apparatus or method for assuring a quality bond between the mounting beam and the semiconductor ingot is needed.

SUMMARY OF THE INVENTION

The invention provides a method and apparatus for ensuring an appropriate bond between a mounting beam and a semiconductor ingot.

In one aspect of the invention, a pressure or force applied to drive the mounting beam and semiconductor ingot together during bonding is controlled.

In one aspect of the invention, an indication of the pressure or force between an ingot and a mounting beam is used to control bonding of the ingot and mounting beam.

Embodiments of the invention provide an ingot mounting device including one or more sensors that sense the pressure or force used to drive a mounting beam and semiconductor ingot together during bonding or otherwise provides an indication of the pressure present between the mounting beam and the semiconductor ingot during bonding.

In one aspect of the invention, the ingot mounting device includes a set of rollers for rotatably supporting a semiconductor ingot and a crosspiece that keeps the semiconductor ingot in contact with the rollers. An ingot holder supports a mounting beam that is forced against the semiconductor ingot during bonding by a driving device. At least one sensor is disposed to sense the force between the driving device and the ingot holder and detect the pressure or force exerted on the ingot holder by the driving device.

In one aspect of the invention, the sensor is linked to a display that provides an indication of the pressure and/or force exerted to drive the semiconductor ingot and beam together.

In one aspect of the invention, a pressure or force detected by the sensor is provided to the driving device to control operation of the driving device.

The invention also provides a method for bonding a semiconductor ingot and mounting beam. According to the method, an adhesive is applied to the mounting beam and/or the semiconductor ingot and the mounting beam and semiconductor ingot are moved together. Thc pressure or force applied to move the semiconductor ingot and the mounting beam together or some other indication representative of the pressure between the ingot and the mounting beam is monitored.

In one aspect of the invention, movement of the semiconductor ingot and the mounting beam toward each other is stopped when a pressure or force applied to move the ingot and beam together reaches a desired level.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

The invention is described below in connection with mounting a semiconductor ingot, but the invention can also be used with any other type of crystal or structure that requires the same or similar mounting techniques.

As discussed above, the bond between a semiconductor ingot and a mounting beam is important to assure proper processing, e.g. slicing of wafers, of the ingot. The inventor has discovered that if too small a force is used to hold a semiconductor ingot and mounting beam together while an adhesive between the ingot and the beam cures, an inadequate bond between the ingot and the mounting beam may be formed and/or the ingot may move, e.g. rotate about its longitudinal axis, relative to the beam. If an inadequate bond is formed between the ingot and the beam, wafers cut from the ingot may be prematurely released from the beam during cutting, thereby causing destruction of the wafer, saw blade or other nearby objects. If the ingot moves relative to the mounting slab, the orientation of the ingot relative to the beam is not assured, and wafers cut from the ingot may not have the proper orientation, e.g. crystallographic or otherwise.

On the other hand, if too high a force is used to hold the semiconductor ingot and the mounting beam together as the adhesive cures, the semiconductor ingot may disengage from devices intended to maintain the orientation of the ingot relative to the mounting beam during curing, and the semiconductor ingot may have to be reoriented and the mounting beam remounted to the ingot.

The inventor has discovered that if the pressure or force used to hold the semiconductor ingot and mounting beam together is maintained at an appropriate level while an adhesive between the two cures, the effects of misorientation or of an inadequate bond discussed above can be avoided.

Figure 1:
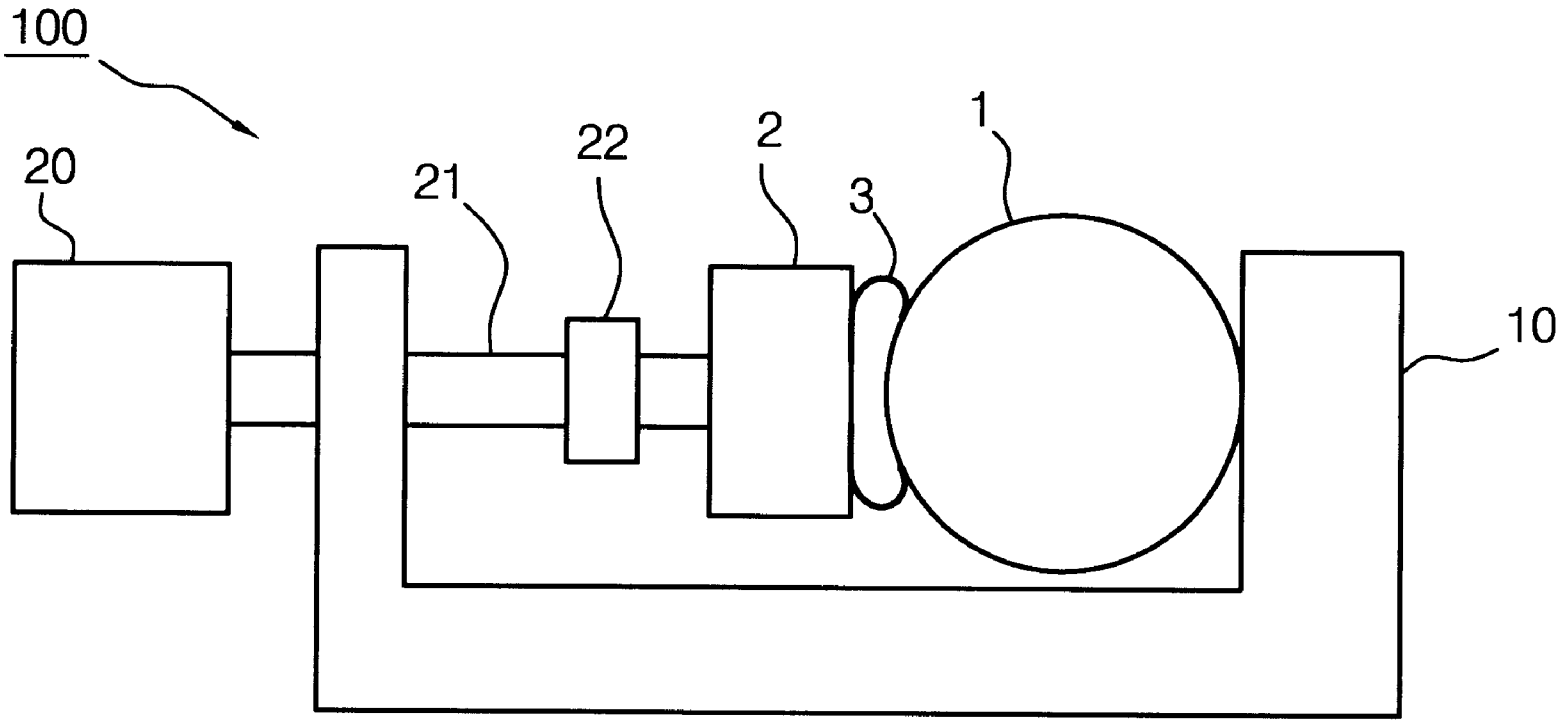
FIG. 1 is a schematic block diagram of a first embodiment of a semiconductor ingot mounting device in accordance with the invention.

FIG. 1 shows a first semiconductor ingot mounting device 100 in accordance with the invention. The mounting device 100 includes a frame 10 that contains a semiconductor ingot 1. A mounting beam 2 engages with the end of a shaft 21 that is movably mounted to the frame 10. A driving device 20, such as a motor or hydraulic cylinder, moves the shaft 21 relative to the frame 10 so that the beam 2 is moved toward the semiconductor ingot 1. A pressure sensor 22 detects the force or pressure exerted by the shaft 21 on the mounting beam 2.

When bonding the semiconductor ingot 1 to a mounting beam 2, the semiconductor ingot 1 is first oriented in a desired position. That is, the semiconductor ingot 1 is rotated about its longitudinal axis or otherwise moved relative to the mounting beam 2 so that the ingot 1 is in a desired position. Then, an adhesive 3, such as a two-part epoxy or other adhesive, is applied to the semiconductor ingot 1 and/or the mounting beam 2. The mounting beam 2 is moved toward the semiconductor ingot 1 by the driving device 20 and the shaft 21. For example, if the shaft 21 threadedly engages with the frame 10, the driving device 20, which can be a motor or a hand-operated handle, rotates the shaft 21 relative to the frame 10 so that the shaft 21 and the mounting beam 2 move toward the semiconductor ingot 1. A pressure sensor 22 detects the amount of force or pressure applied to the mounting beam 2 to force the mounting beam 2 and the semiconductor ingot 1 together. In this example, the pressure sensor 22 is a load cell that directly detects the amount of force transmitted by the shaft 21 to the mounting beam 2.

However, the amount of force or pressure used to move and/or hold the semiconductor ingot 1 and the mounting beam 2 together can be determined in other ways. For example, if the driving device 20 is a hydraulic cylinder, a pressure of the hydraulic fluid in the cylinder can be detected, thereby providing an indication of the amount of force used to drive the semiconductor ingot 1 and the mounting beam 2 together. If the driving device 20 is a motor or other rotational driving element, an amount of rotational drive force applied to the shaft 21 can be detected. In addition, deformation of the frame 10, the mounting beam 2, the semiconductor ingot 1 or other member can be detected (e.g. by a strain gage, a change in optical or other physical properties, etc.) to provide an indication of the amount of force used to move and/or hold the semiconductor ingot 1 and the mounting beam 2 together.

Thus, the pressure sensor 22 can take many forms and be located in a variety of different locations, e.g. anywhere along the shaft 21, within the driving device 20, on or between the semiconductor ingot 1 and/or the mounting beam 2, within the adhesive 3, on or in the frame 10, etc. In addition, the adhesive 3 could be formulated to provide an indication that an appropriate level of force is being applied between the mounting beam 2 and the semiconductor ingot 1. For example, microcapsules of a dye within the adhesive 3 could rupture when an appropriate amount of force or pressure is reached, thereby indicating visually that no further force should be applied. Of course, the adhesive 3 could be formulated in other ways to provide an indication of the amount of force or pressure existing at the mounting beam 2/semiconductor ingot 1 interface.

When an appropriate or desired level of force is reached, the semiconductor ingot 1 and the mounting beam 2 are not moved together any further. Preferably, a desired clamping pressure or force is maintained until the adhesive 3 reaches a desired state. Typically, the adhesive 3 hardens within five hours.

Figure 2:
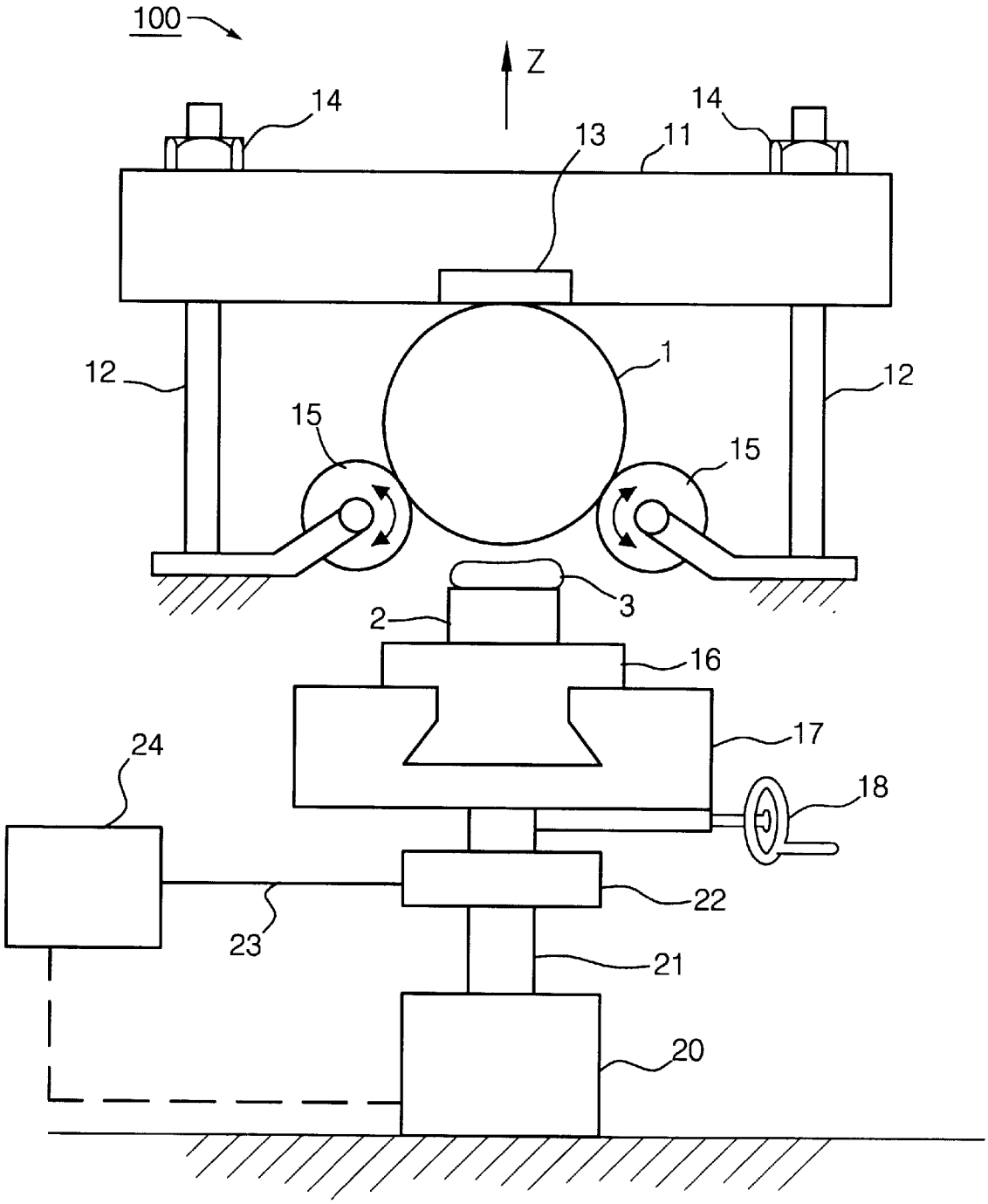
FIG. 2 is a schematic block diagram of a second embodiment of a semiconductor ingot mounting device in accordance with the invention.

FIG. 2 shows a second mounting device 100 in accordance with the invention. The semiconductor ingot 1 is mounted on a pair of rollers 15 that can rotate as shown or be locked in a desired position. Thus, the semiconductor ingot 1 can be rotated about its longitudinal axis and positioned as desired. Once the semiconductor ingot 1 is positioned as desired, the rollers 15 are locked in position and a crosspiece 11 is lowered on a pair of linear bearings 12 so that an insert 13 mounted on the crosspiece 11 contacts the semiconductor ingot 1. The insert 13, which is typically made of plastic, is used to align the ingot 1. Clamps 14, usually in the form of clamp bolts, are tightened to fix the crosspiece 11 with respect to the linear bearings 12. An adhesive 3, typically a two-part epoxy, is spread on the mounting beam 3 and an optional ingot holder 16. The ingot holder 16, if used, is preferably mounted in a dovetail slot in a rotary table 17, which can rotate about the Z axis shown in FIG. 2. However, the ingot holder 16 could be supported by the rotary table 17 in other ways, e.g. directly connected by bolts or in a mechanically mating arrangement. Thus, the beam 3 can be positioned rotationally around the Z axis with respect to the semiconductor ingot 1. The rotary table 17 preferably has an indicator (not shown) that displays an angular position of the rotary table 17. The rotary table 17 may be rotated using a crank 18, or can be rotated by other methods. Like the rotary table 17, the rollers 15, the linear bearings 12, crosspiece 11, etc. can preferably rotate about the Z axis so the ingot 1 can be positioned rotationally relative to the Z axis in a desired location.

The rotary table 17 is moved upward toward the semiconductor ingot 1 by a driving device 20 and associated shaft 21. The driving device 20 is preferably a manually or automatically operated screw jack, but can be any one of many different types of devices, including manually or automatically operated hydraulic rams, one or more screw-driven shafts 21, etc. A pressure sensor 22 is disposed between sections of the shaft 21 to detect the amount of pressure transmitted through the shaft 21 to the rotary table 17, ingot holder 16 and mounting beam 3 assembly. In this embodiment, the pressure sensor 22 can be, for example, a pancake load cell, such as model LGP310 manufactured by Cooper Instruments and Systems. The pressure sensor 22 may communicate by a lead 23 with a display 24 so that a pressure sensed by the pressure sensor 22 can be displayed. Although not necessary, the sensed pressure can be provided to the driving device 20 so that movement of the mounting beam 3 can be automated. That is, the driving device 20 could be controlled so that the mounting beam 3 is moved toward the semiconductor ingot 1 until a predetermined pressure is sensed by the pressure sensor 22 and fed back to the driving device 20. However, such feedback control of the driving device 20 is not necessary. Instead, an operator could activate the driving device 20, visually monitor the display 24, and stop operating the driving device 20 to move the mounting beam 3 upward when a desired pressure is achieved.

If the driving device 20 is feedback controlled, the driving device 20 preferably includes a controller to receive pressure/force information and control the driving mechanism(s) accordingly. The controller can be implemented, at least in part, as a single special purpose integrated circuit (e.g., ASIC) or an array of ASICs, each having a main or central processor section for overall, system-level control, and separate sections dedicated to performing various different specific computations, functions and other processes under the control of the central processor section. The controller can also be implemented using a plurality of separate dedicated programmable integrated or other electronic circuits or devices, e.g., hardwired electronic or logic circuits such as discrete element circuits or programmable logic devices. The controller preferably includes other devices, such as volatile or nonvolatile memory devices, communications devices, relays, motors, mechanical linkages, and/or other circuitry or components necessary to perform the desired input/output or other functions.

The inventor has discovered that an appropriate method for determining the desired force for holding the semiconductor ingot 1 and the mounting beam 3 together during adhesive 3 cure using the FIG. 2 embodiment is to multiply the semiconductor ingot 1 weight in pounds by a constant, such as 2.5. For example, a 2,000 mm diameter silicon ingot having a length of 150 mm and weighing 24 pounds requires an approximate mounting force of 60 pounds for a given amount and type of adhesive.

The constant used to determine a mounting force can be determined empirically for any given system, and depends, in part, on how the pressure or force used to move the ingot 1 and the mounting beam 2 together or the pressure between the ingot 1 and the mounting beam 2 is measured.

Although the pressure sensor 22 is shown in the mounting device 100 as disposed between sections of the shaft 21, as discussed above, the pressure sensor 22 can be located in various different places and operate in many different ways. For example, the pressure sensor 22 could be located between the rotary table 17 and the ingot holder 16, between the ingot holder 16 and the mounting beam 3, between the mounting beam 3 and the semiconductor ingot 1, etc. In addition, the amount of pressure or force between the mounting beam 3 and the semiconductor ingot 1 can be determined in other ways, including detecting deformation of the crosspiece 11, the shaft 21, or other appropriate members, e.g. by using a strain gage, by detecting a change in optical or other physical properties of the semiconductor ingot 1 and/or the mounting beam 3 and/or other parts of the mounting device 100, etc.

Although in the embodiments described above the mounting beam 2 is moved toward the ingot 1, the ingot 1 could be moved toward a fixed mounting beam 2, or the ingot 1 and the mounting beam 2 could both be movable.

While the invention has been described with specific embodiments, the description of the specific embodiments is illustrative only and is not to be construed as limiting the scope of the invention. Various other modifications and changes may occur to those skilled in the art without departing from the spirit and scope of the invention.

What is claimed is:

1. An ingot mounting device comprising:

a positioning device that moves an ingot and a mounting beam toward each other; and a force detector that provides an indication of an amount of pressure between the ingot and the mounting beam.

2. The ingot mounting device of claim 1, wherein the positioning device comprises a driving device that moves the mounting beam and the semiconductor ingot together, and the force detector comprises a pressure sensor that detects an amount of pressure transmitted between the driving device and one of the mounting beam and the ingot.

3. The ingot mounting device of claim 2, wherein the driving device comprises a screw jack.

4. The ingot mounting device of claim 2, wherein the positioning device further comprises:

an ingot holder that supports the mounting beam; and a rotary table that supports the ingot holder and receives a driving force from the driving device;

wherein the pressure sensor senses a pressure transmitted by the driving device to the rotary table.

5. The ingot mounting device of claim 4, wherein the positioning device further comprises:

at least two rollers that support the ingot and are selectively one of rotatable about a longitudinal axis and fixed; and a crosspiece that maintains the ingot in contact with the at least two rollers.

6. The ingot mounting device of claim 1, wherein the force detector comprises:

a pressure sensing device; and a display that is linked to the pressure sensing device and displays an indication of an amount of pressure sensed by the pressure sensing device.

7. The ingot mounting device of claim 1, wherein the force detector comprises:

a pressure sensing device that provides an indication of the amount of pressure between the mounting beam and the ingot.

8. The ingot mounting device of claim 1, wherein the force detector comprises:

a pressure sensing device that provides an indication of the amount of pressure between the mounting beam and the ingot; and a feedback control device that provides an indication of the amount of pressure to control a rate at which the ingot and mounting beam are moved together.

9. A method for mounting an ingot to a mounting beam, comprising:

positioning an ingot and a mounting beam in desired locations relative to each other;

applying an adhesive to at least one of the mounting beam and the ingot;

moving the ingot and the mounting beam together;

obtaining an indication of an amount of pressure between the mounting beam and the ingot; and controlling at least one of a rate and a distance which the ingot and the mounting beam are moved together based on the indication of the amount of pressure between the ingot and the mounting beam.

10. A method of mounting an ingot on a mounting beam, comprising:

moving the mounting beam and the ingot together; and determining an indication representative of an amount of pressure between the ingot and the mounting beam.

11. The method of claim 10, further comprising:

positioning the mounting beam and the ingot in desired locations relative to each other; and applying an adhesive to at least one of the mounting beam and the ingot.

12. The method of claim 10, wherein the step of moving the mounting beam and the ingot comprises:

operating a driving device to move the mounting beam toward the ingot.

13. The method of claim 10, wherein the step of determining an indication of the amount of pressure comprises:

detecting an amount of pressure exerted on one of the mounting beam and the ingot.

14. The method of claim 10, wherein the step of determining an indication of the amount of pressure comprises:

detecting an amount of deformation of one of the mounting beam, the ingot, a crosspiece, a driving shaft, and a clamping device.

15. The method of claim 10, further comprising:

controlling a rate at which the mounting beam and the ingot are moved together based on the indication.

16. The method of claim 15, further comprising:

displaying the indication representative of the amount of pressure.

17. An ingot mounting device comprising:

a positioning device that moves an ingot and a mounting beam toward each other;

a force detector that provides an indication of an amount of pressure between the ingot and the mounting beam;

at least two rollers that support the ingot, the rollers being selectively one of rotatable and fixed;

a crosspiece that maintains the ingot in contact with the rollers; and a rotary table that supports the mounting beam and is selectively rotatable.

18. The ingot mounting device of claim 17, further comprising:

at least two linear bearings that support the crosspiece; and an ingot holder that is received by the rotary table and supports the mounting beam.

19. The ingot mounting device of claim 17, wherein the positioning device comprises a driving device that moves the mounting beam and the semiconductor ingot together, and the force detector comprises a pressure sensor that detects an amount of pressure transmitted between the driving device and one of the mounting beam and the ingot.

* * * * *